United States Patent [19]

Kuffner

[11] Patent Number: 4,564,975

[45] Date of Patent: Jan. 21, 1986

[54] HINGE HARDWARE ELEMENT FOR DOORS AND WINDOWS OF BUILDING AND FURNITURE

[75] Inventor: Reinhold O. Kuffner, Karlsruhe, Fed. Rep. of Germany

[73] Assignee: Kuffner Innenausbau, Karlsruhe, Fed. Rep. of Germany

[21] Appl. No.: 477,909

[22] Filed: Mar. 23, 1983

[30] Foreign Application Priority Data

Mar. 24, 1982 [DE] Fed. Rep. of Germany ..... 3210721

[51] Int. Cl.[4] ..... E05D 15/32

[52] U.S. Cl. ..... 16/370; 16/366; 16/368

[58] Field of Search ..... 16/370, 282, 288, 294, 16/302, 233, 268-270, 379, 323, 346, 364, 367, 360

[56] References Cited

U.S. PATENT DOCUMENTS

| | | | |
|---|---|---|---|
| 1,019,096 | 3/1912 | Soss | 16/368 |
| 1,034,158 | 7/1912 | Soss | 16/370 |
| 2,063,686 | 12/1936 | Lefeure | 16/370 |
| 2,639,462 | 5/1953 | Fish | 16/302 |
| 4,383,347 | 5/1983 | La Conte | 16/370 |
| 4,446,597 | 5/1984 | Dantzer-Sorensen et al. | 16/370 |

FOREIGN PATENT DOCUMENTS

| | | | |
|---|---|---|---|
| 2526433 | 12/1976 | Fed. Rep. of Germany | 16/368 |
| 2541144 | 3/1977 | Fed. Rep. of Germany | 16/294 |
| 2723031 | 11/1978 | Fed. Rep. of Germany | 16/370 |

*Primary Examiner*—Donald R. Schran
*Assistant Examiner*—James Wolfe
*Attorney, Agent, or Firm*—LaValle D. Ptak

[57] ABSTRACT

A hinge for building doors and windows is recessed into the jamb when the door or window is closed and includes pivotally interconnected 4-bar link mechanisms which function to swing the end face of the door completely out of the way of the inside cross-section of the door opening when the door is opened from an angle of 90° to substantially a full 180° nearly parallel to the wall in which the door jamb is located.

10 Claims, 6 Drawing Figures

HINGE HARDWARE ELEMENT FOR DOORS AND WINDOWS OF BUILDING AND FURNITURE

Figure 1:
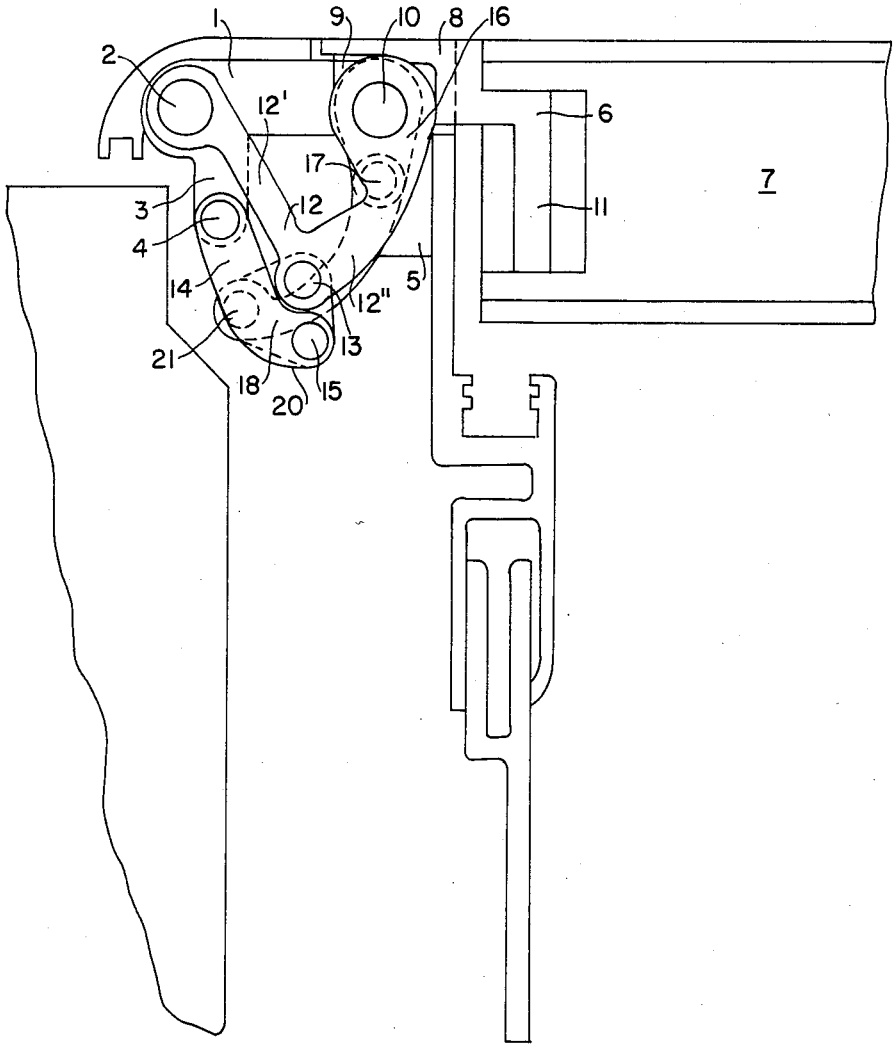

The invention relates to a hinge hardware element for building and furniture doors and windows, the panels of which when opened are supposed to leave the inside cross section of the doorway or window opening entirely clear. The hardware element has a fastening part to be attached to the jamb and a bearing-surface part to be attached to the door panel, and these parts are connected to one another via a lever mechanism.

Door hinge hardware which more or less satisfies this requirement is in use in many forms. A failing common to the majority of such hardware is that it does not clear the inside cross section of the doorway entirely, since at least some relatively small parts of the hardware protrude into the opening. Two constructions which differ in their function must also be distinguished from one another in this respect. One construction provides that the door panel is swung open only to an angle of 90°, in which case the end face of the door panel then in fact swings out of the way of the inside cross section of the opening, but it is impossible to open the door more fully, such as to an angle of about 180°. In the second type of construction, the panel can be swung open about an angle of 180°, and when thus fully open the end face of the door panel does in fact swing out of the inside cross section—but not when the door is opened to a lesser angle, such as only 90°.

In view of the above, it is the object of the invention to create a hinge hardware element of the general type described above but which entirely clears the inside cross section of the door or window opening when the panel is swung open about an angle of 90° as well as 180°—and of course any angle between these two limits. Hinge hardware elements of this type generally comprise a fastening part to be attached to the door or window jamb and a bearing-surface part to be attached to the door panel, these parts being connected to one another via a lever mechanism. The attainment of this object depends upon successfully embodying the hinge hardware element as a whole such that all its parts are sunk in recesses in the jamb when the door or window is closed, while when the door or window is opened these parts emerge not in the direction of the inside cross section but only in a direction perpendicular thereto.

In a hinge hardware element of the above general type, this object is attained in that the lever mechanism comprises two 4-bar link mechanisms, one of which originates with the fastening part attached to the jamb and has two articulated shafts as a base and which is substantially embodied by one arm of a bell-crank lever, one curved lever and one coupler connecting the two via articulated shafts, and the other of which originates with the bearing-surface part disposed on the end face of the door panel and has two articulated shafts as a base and which is substantially embodied by the other arm of the bell-crank lever, a swing arm and the coupler with the associated articulated shafts. The two 4-bar link mechanisms have a positive kinematic connection with one another via the common bell-crank levers, the common coupler and at least one common articulated shaft. All the parts of the hardware element are countersunk in recesses of the jamb or of the end face of the door panel when the door is closed, and the 4-bar link mechanisms are embodied and disposed such that when the door is opened, the second 4-bar link mechanism emerges from its recesses substantially at right angles to the adjacent wall or to the narrow side of the jamb.

With the dimensions of the individual members of the mechanism being selected in accordance with the intentions of one skilled in the art, the embodiment and disposition of this lever mechanism has the desired result that in no phase of the entire process of opening the door do any members whatever of the mechanism protrude into the inside cross section of the opening, whether the door is opened to an angle of 90°, 180°, or any angle between these two limits.

Having great significance for the function of the lever mechanism in accordance with the invention is the provision that the swing arm of the second 4-bar link mechanism engages the common coupler with a third articulated shaft, which is disposed spaced apart not only from the articulated shaft common to the two 4-bar link mechanisms but also from the further articulated shaft of the first 4-bar link mechanism.

In a preferred form of embodiment, it is provided that the three articulated shafts are disposed on the coupler at the corners of a triangle, preferably an isosceles triangle. The result then is that upon the actuation of the hinge hardware, that is, when the panel hinged to it is opened or closed, both 4-bar link mechanisms are pivoted in one rotational direction while the triangular coupler is pivoted in the opposite rotational direction.

As already mentioned in general terms, the jamb or the body of the door or window frame has one or more recesses on the long edge adjacent to the door panel, at least in the area where the brackets are fastened. These recesses receive the entire lever mechanism including both 4-bar link mechanisms when the door or window is in the closed position, the first arm of the bell-crank lever and the curved lever being located approximately parallel to one another and spaced closely apart from one another.

The bell-crank lever is preferably embodied such that the articulated shafts, which pass through the free end points of the bell-crank lever and its apex, are located in the corners of an acute, preferably isosceles triangle, the acute angle of which is located on the base shaft. As a result of this embodiment, it is attained that the pivot radius for the bell-crank lever can be very small.

In a simple form of embodiment for less stringently demanding uses, it may be provided that the bell-crank lever and the curved lever are disposed in one plane, while the coupler and the swing arm are disposed in another plane parallel thereto.

For more stringent demands, a symmetrical embodiment of the hinge hardware appears to be more useful; the bracket serving as the fastening means then has a congruent second bracket associated with it, the second bracket being disposed on the door jamb at a vertical interval from the first bracket such that it is possible to insert the lever mechanism between the two brackets by means of the base shafts passing through both brackets.

The two brackets are embodied as substantially U-shaped hardware parts, one arm of each U serving to fasten them to the jamb and the other arm of each U forming, with the base shafts, the base of the first 4-bar link mechanism.

In a similar manner it is provided that the bearing-surface part, which is at the same level as the levers of the first 4-bar link mechanism, is embodied as substantially U-shaped; with one arm of the U, it is fastened to the end face of the door panel, while the other arm of the U acts as a bearing block for the two base shafts of the second 4-bar link mechanism, and the base of the U of the bearing-surface part, which is extended at one side, forms an end stop for the opening of the door.

In order to complete the symmetry of the hardware element, it is provided that the bearing block at the same level as the bearing-surface part is offset at its vertical middle forming a boss protruding at one side; one end of the swing arm engages this boss by means of a bearing bolt, and the other end of the swing arm is supported on the coupler by means of another bearing bolt.

The same purpose is also served by the provision that the bell-crank lever and the curved lever, which are both greater in height than in length, each have in their vertical middle a recess extending in the transverse direction over the greater part of their length as far as the vicinity of where they are supported on the base shafts. When the lever mechanism is moved, the coupler, boss and swing arm can be sunk into this recess.

A particular advantage of the hinge hardware element according to the invention which should be mentioned is that it is particularly suitable, given an appropriate selection of the dimensions of the hardware parts and the members of the lever mechanism, for heavy building doors, such as fire doors and the like.

In a still more-complete realization of the invention, it is provided that the coupler comprises two congruent coupler members disposed spaced apart from one another vertically, between which members one end of the appropriately dimensioned swing arm is supported, and that the two coupler members are connected, on their sides remote from one another, with the bell-crank lever and the curved lever via the two articulated shafts.

In a further realization of the symmetrical embodiment, it is provided that the boss protruding from the bearing block has in its vertical middle a horizontal gap, which is entered and engaged by the second (outer) end of the swing arm on the bearing bolt which passes through the gap.

With this embodiment, truly complete symmetry of the hinge hardware element is attained, with the resultant advantages associated with the avoidance of unbalanced loads on the mechanism. In an extreme case, with particularly heavy panels, a hinge hardware element of this kind could extend over the entire height of the bearing surface of the door, as may be desired for the doors of safes, for instance. For less demanding uses, it is sufficient in every case to dispose two or at the most three hinge hardware elements of like embodiment along the bearing surface of the door at suitably selected intervals.

In the drawings, one exemplary embodiment of the hinge hardware element according to the invention is shown in various positions.

Figure 2:
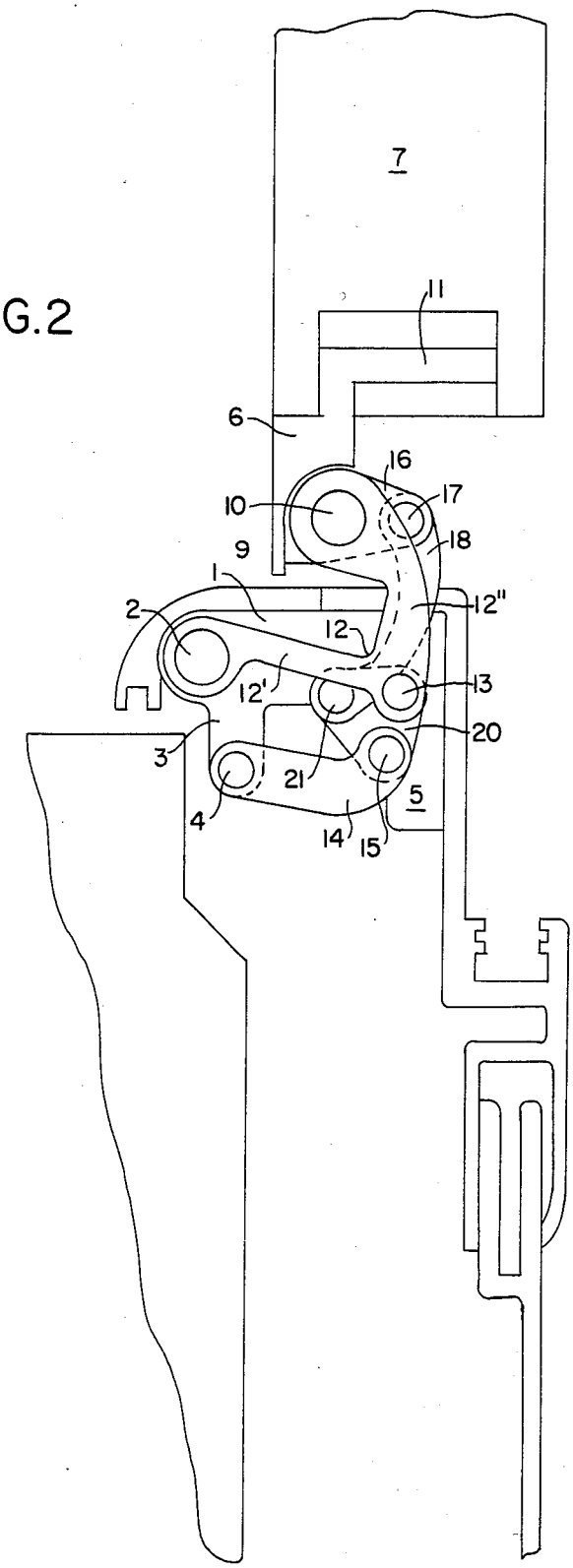
Figure 3:
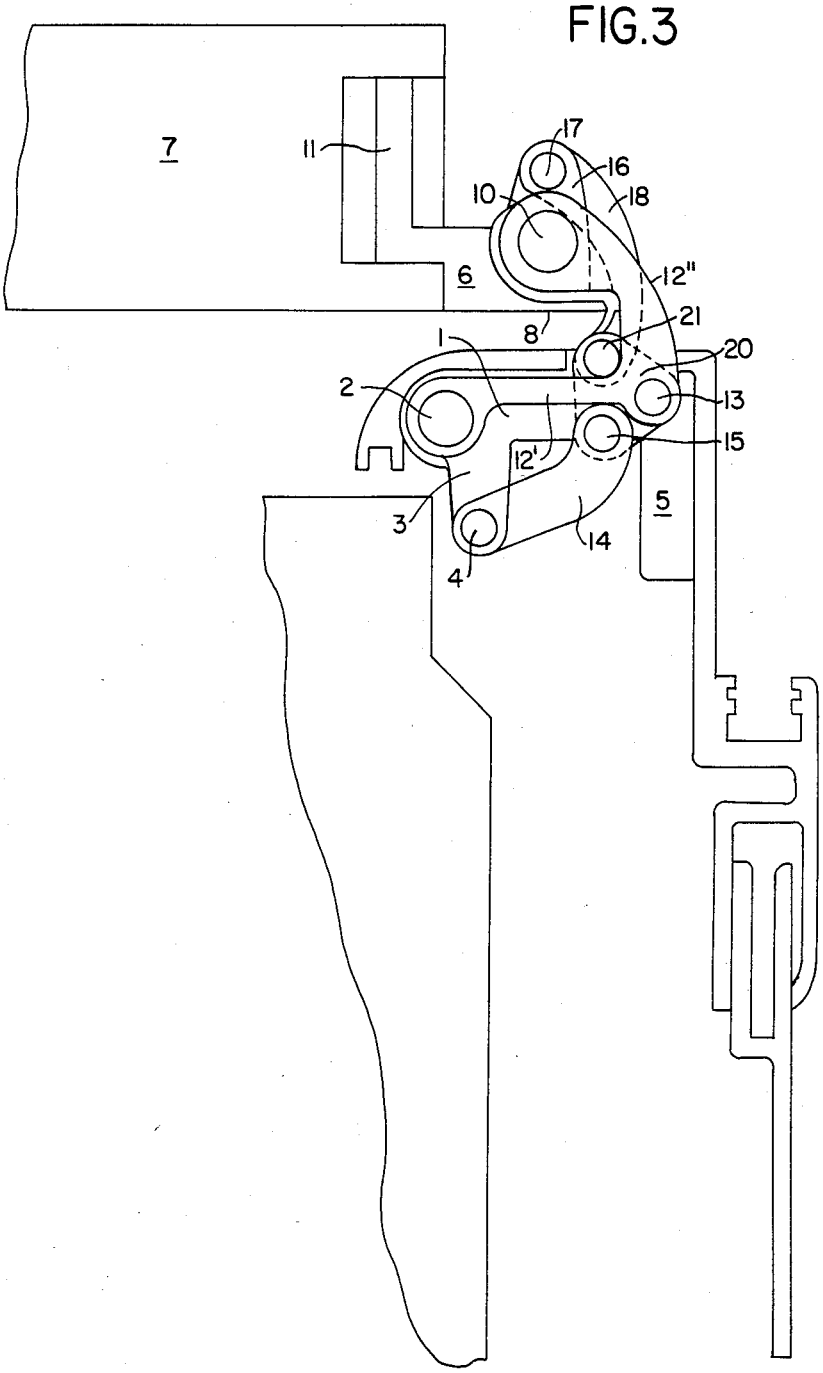

Shown are:

FIG. 1, the hinge hardware element, attached to the jamb of a door and to the door panel itself, along with the directly adjacent parts of the jamb and door panel, seen in a plan view or in horizontal section, with the door in the claimed position;

FIG. 2, the same, with the door in a position pivoted by 90° as compared with FIG. 1;

FIG. 3, the same, the door having been pivoted by 180° as compared with FIG. 1; and FIG. 4, the lever mechanism of the hinge hardware element, shown in highly schematic fashion as follows:

(a) in the closed position of the door;

(b) in a position pivoted by 90°; and (c) in a position of the door pivoted by 180°.

A bracket 1 is rigidly fastened to the jamb as shown in U.S. Pat. No. 4,179,849 and is substantially embodied as a U-shaped workpiece. On one angle of the U—on the left in the drawing—it has a first bearing bore with a stationary shaft 2; on the free end of the left arm 3 of the U it has a bore with a second stationary shaft 4, which is offset in parallel with the shaft 2. The second arm 5 of the U serves to fasten the bracket on the inner side of the jamb. A second bracket (not shown in the drawing), embodied identically to the first, is associated with the first and spaced apart from it by approximately 20 cm; the shafts 2 and 4 extend over the intervening space between the first and the second bracket. Furthermore, as is generally the case in this field of technology, at least one second hinge hardware element is associated with this hinge hardware element, disposed at a different level perpendicular to the plane of the drawing.

A multiple-member lever link mechanism is articulated on the shafts 2, 4 extending between the two brackets 1; at its opposite end, the lever mechanism engages a rectangular bearing-surface part 6 for the door panel 7. To this end, the bearing-surface part 6 has a bearing block 9 for a shaft 10 of the lever link mechanism disposed on one arm 8 of the bearing-surface part 6; fastening devices for the door panel are provided on the other arm 11.

The lever link mechanism substantially comprises a bell-crank lever 12, which with the end of one arm 12' is supported on the stationary shaft 2, and with the end of the other arm 12'' is supported by means of a forked bearing on the shaft 10. In the angle of the bell-crank lever 12, a further shaft 13 is inserted, which passes longitudinally through it at a level perpendicular to the plane of the drawing and the purpose of which will be discussed later herein. A slightly curved lever 14 is supported on the second stationary shaft 4 such that it is pivotable at one end; on its free end, in turn, it carries a shaft 15 which in the exemplary embodiment passes through it longitudinally.

Both the bell-crank lever 12 and the curved lever 14 extend perpendicular to the plane of the drawing between the two brackets 1 and in the vicinity of their middle each has a recess, which extends in the transverse direction from the outer edge as far as the vicinity of their support on the shafts 2 and 4, respectively. In the same vicinity, the bearing block 9 is extended eccentrically relative to a boss 16 in the direction parallel to the fastening arm 11 of the bearing-surface part 6; at the end of this boss 16, the bearing block 9 has a bearing eye for a short bearing bolt 17, on which the end of a swing arm 18 is supported. The bearing eye and the bearing bolt 17 are embodied in height such that they are capable of entering the recess of the two levers 12, 14. Also disposed in the recess of the two levers 12, 14 and spaced apart from one another are two coupler members 20, which are identical in shape and in function and which in the form of embodiment illustrated are approximately the shape of an equilateral triangle; the swing arm 18 meshes between these members 20 in a freely movable manner. At each corner the coupler members 20 have a bearing bore, through the first of which is guided a bearing bolt 21 connecting the coupler members and on which the swing arm 18 is supported. The second bearing bore of the coupler members 20 has the shaft 15 of the curved lever 14 passing through it for its entire length. The shaft 13 of the bell-crank lever enters the third bearing bore from both sides, but leaves open the space between the coupler members 20 to provide play for the movement of the swing arm 18. As may readily be recognized, this form of embodiment is completely symmetrical with respect to its central horizontal cross-sectional plane. As may also be easily seen, the bell-crank lever 12 and the curved lever 14 are coupled to one another by means of their shafts 13 and 15 via the two coupler members 20. The coupler members further guide the swing arm 18 via the bearing bolt 21 and thus, via the bearing bolt 17 and the boss 16 of the bearing block 9 of the bearing-surface part 6, guide the door panel 7 in the course of the pivoting movement about the shaft 10. The selected shapes and dimensions of the brackets 1 of the bearing-surface part 6, with the associated bearing block 9, the bell-crank lever 12, the curved lever 14, the boss 16, the swing arm 18 and the coupler members 20, as well as the disposition of the base shafts 2, 4 and the movable shafts 10, 13, 15, 17 and 21 have as a consequence the fact that upon the opening of the door, the door panel is positively guided by means of the lever mechanism such that the door opening is left entirely clear whether the door is opened to 90° or 180°. It should be emphasized that in the cooperation of the members of the lever mechanism, the pivoting movement of these members has already virtually ended once the door has been opened to an angle of 90°, and during the further opening to an angle of up to 180° the only substantial movement which continues to take place is a rotational movement about the shaft 10 in the bearing-surface part 6, and this is chiefly on the part of the curved lever 14 and the swing arm 18 upon a rotational movement of the coupler members 20 about the shaft 13.

Upon closer consideration, it is found that one arm 12' of the bell-crank lever 12 and the curved lever 14, along with the arm 3 of the bracket 1 and the stationary shafts 2 and 4 as a base as well as the triangular coupler members 20 acting as a unitary coupler and having the stationary shafts 13, 15 form a 4-bar link-mechanism, one lever of which is the arm 12'; the lever is extended, however, beyond the arm 12', with a right-angle bend and an additional curvature, in the form of the arm 12'', which in the terminal position engages the shaft 10 guided by means of the bearing 9 in the bearing-surface part 6. The swing arm 18 is furthermore supported at 21 on the coupler members 20 of this link mechanism; in its final position, the swing arm 18 engages the bearing tang 17, offset parallel to the shaft 10, of the boss 16 of the bearing-surface part 6.

This last-mentioned arrangement thus forms a second 4-bar link mechanism with the boss 16 disposed in a stationary manner in the bearing-surface part 6 as a base, the arm 12'' of the bell-crank lever 12 as one, [sic] the swing arm 18 as a corresponding lever and the coupler 20 as the final member. The two 4-bar link mechanisms are articulated relative to one another via the coupler 20 and are rigidly connected with one another via the lever 12, since one arm 12' of the lever is part of the first 4-bar link mechanism and the other arm 12'' is part of the second 4-bar link mechanism.

Figure 4A:
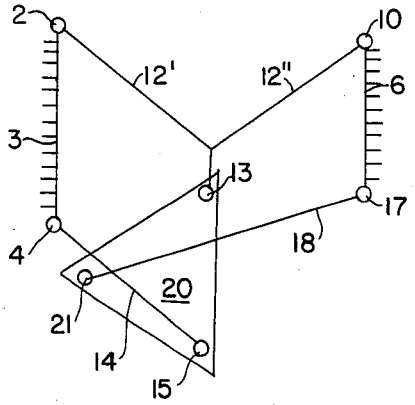
Figure 4B:
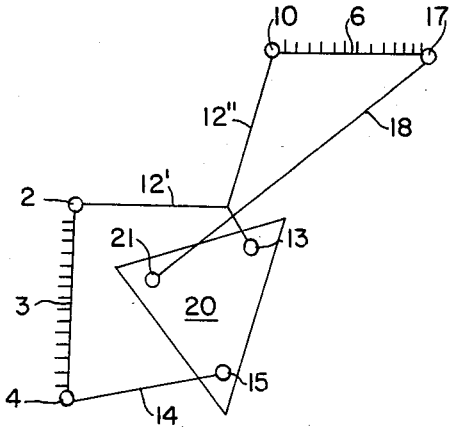
Figure 4C:
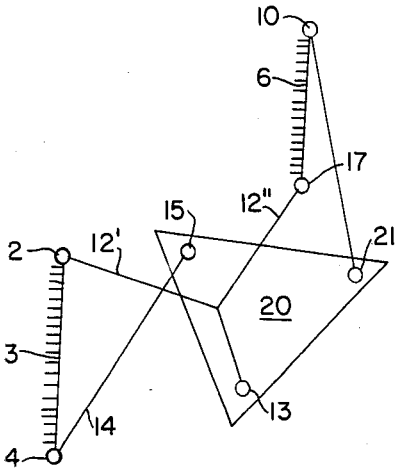

In FIGS. 4*a, b, c* the attempt has been made to make the not-readily-apparent relationships between the members of the lever link mechanism and its movements more comprehensible by means of a highly schematic illustration. In so doing, it was not possible to represent the proportional size of the members to scale.

FIGS. 4*a, b* and *c* correspond to the closed or open positions shown in FIGS. 1, 2 and 3. The reference numerals correspond to those used in the foregoing description of the non-schematic drawings, FIGS. 1–3.

List of reference numerals

1—Bearing surface, bracket
2—stationary first shaft
3—first arm of U
4—stationary second shaft
5—second arm of U
6—bearing-surface part
7—door panel
8—first arm of bearing-surface part 6
9—bearing block on 8
10—shaft of lever mechanism
11—fastening arm of 6
12—bell-crank lever

| | |
|---|---|
| 12' — one arm<br>12'' — the other arm | of the bell-crank lever |

13—angle shaft
14—curved lever
15—shaft at end of 14 (connection to coupler)
16—boss of the bearing block
17—bearing bolt in boss 16
18—swing arm
20—coupler or coupler members
21—bearing bolt in coupler 20 for swing arm 18
2—stationary first base shaft on bracket 1
4—stationary second base shaft on bracket 1
10—first base shaft on bearing-surface part 6
17—second base shaft on boss 16
13—shaft in angle of bell-crank lever
15—shaft at end of curved lever
21—bearing bolt for swing arm 18 on coupler 20

I claim:

1. A hinge hardware element for building and furniture doors and windows, which after opening 90 degrees to 180 degrees leaves the inside cross-section of the door or window opening entirely clear, having a fastening part attached to the jamb and a bearing-surface part attached to the door, which parts are connected with one another by way of a lever mechanism, said lever mechanism including in combination:

(a) first 4-bar link mechanism having a first base attached to the jamb; first and second spaced-apart parallel shafts extending from said base; a bell crank lever having a first arm pivoted at one end on said first shaft; a second lever member; a coupler; third and fourth shafts parallel to said first and second shafts, said third shaft pivotally interconnecting said coupler and the other end of said arm of said bell crank lever at the apex thereof, said fourth shaft interconnecting one end of said second lever member with said coupler, the other end of said second lever member being pivotally mounted on said second shaft; and (b) a second 4-bar link mechanism having a first part for attachment to the end face of a door panel; a second base extending from said first part; fifth and sixth spaced-apart shafts mounted on said second base and extending parallel to said first and second shafts; a second arm of said bell crank lever pivotally mounted at one end on said fifth shaft, the other end of such second arm of said bell crank lever being in common with the other end of the first arm of said bell crank lever at the apex thereof; a swing arm member pivotally mounted at one end on said sixth shaft; a seventh shaft pivotally interconnecting the other end of said swing arm member and said coupler; wherein said bell crank lever interconnects said first and second 4-bar link mechanisms; wherein said third, fourth, and seventh shafts are arranged on said coupler in the corners of a triangle; and wherein said lever mechanism, in the closed state of the door, is mounted in a recess in the jamb or the end face of the door with the interrelationship of the various levers and pivots being such that such parts of said lever mechanism emerge only at right angles to the door opening of the jamb.

2. A hinge hardware element according to claim 1, wherein the jamb of the door or window frame has a recess at least in the vicinity of the fastening of said first base on a long edge of the jamb adjacent to the door panel, which recess in the closed position of the door receives the entire lever mechanism including said first and second 4-bar link mechanisms, and wherein said one arm of said bell crank lever and said second lever are spaced closely together and approximately parallel to one another.

3. A hinge hardware element according to claim 1, wherein said first, fifth and third shafts which pass through the ends of said arms of said bell-crank lever and the apex thereof are located in the corners of an acute isosceles triangle, the most acute angle of which is located on said first shaft.

4. A hinge hardware element according to claim 1, wherein said bell-crank lever and said second lever are in one plane and said coupler and said swing arm are in a second plane parallel to said one plane.

5. A hinge hardware element according to claim 1, wherein said second base member is substantially U-shaped and is fastened with one arm of the U to the end faces of the door, while the other arm of the U forms a bearing block for said fifth and sixth shafts and the base of the U, extended at one side, forms an end stop for the opening of the door.

6. A hinge hardware element according to claim 5 wherein said bearing block is offset at the middle of its height to form a boss protruding at one side, and further including a bearing bolt coupling said boss to one end of the swing arm, the other end of which is supported by means of said seventh shaft on the coupler.

7. A hinge hardware element according to claim 6, wherein said, bell-crank lever and said second lever arm are greater in height than in length, and each have in the middle of their height a recess extending in the transverse direction over the major part of their length to said first and second shafts, into which recess, upon the movement of said lever mechanism, said coupler, said boss and said swing arm are countersunk.

8. A hinge hardware element according to claim 7, wherein said coupler comprises two congruent coupler members spaced apart vertically from one another, between which one end of said swing arm is supported, said two coupler members being connected with said bell-crank lever and said second lever arm on the sides of said coupler members remote from one another, via said third and fourth shafts.

9. A hinge hardware element according to claim 8, wherein said boss has in the middle of its height a horizontal gap, in which the other end of said swing arm engages said bearing bolt passing through said boss.

10. A hinge hardware element according to claim 1, wherein said first base member is substantially U-shaped, one arm of which is fastened to the jamb, and the other arm of the U of which together with the base of the U supports said first and second shafts.

* * * * *